US005136957A

United States Patent [19]

Nielsen, Jr.

[11] Patent Number: 5,136,957

[45] Date of Patent: Aug. 11, 1992

[54] TOPSTITCH GUIDE

[76] Inventor: George M. Nielsen, Jr., 812 Ward Basin Rd., Milton, Fla. 32583

[21] Appl. No.: 684,988

[22] Filed: Apr. 15, 1991

[51] Int. Cl.[5] ..... D05B 1/00; D05B 35/00

[52] U.S. Cl. ..... 112/262.3; 112/136

[58] Field of Search ..... 112/260, 136, 140, 141, 112/147, 152, 153, 262.1, 262.3

[56] References Cited

U.S. PATENT DOCUMENTS

| | | | |
|---|---|---|---|
| 3,006,301 | 5/1958 | Leonard et al. . | |
| 3,146,743 | 9/1964 | Minchan . | |
| 3,192,885 | 7/1965 | Timm . | |
| 3,559,585 | 8/1971 | Myrick . | |
| 3,796,173 | 3/1974 | Godsen | 112/235 |
| 4,280,422 | 7/1981 | Jung | 112/153 X |
| 4,407,208 | 10/1983 | Meyer | 112/121.12 |
| 4,473,017 | 9/1984 | Letard et al. | 112/141 |
| 4,509,440 | 4/1985 | Freermann | 112/153 |
| 4,744,317 | 5/1988 | Cullen et al. | 112/153 X |
| 5,031,551 | 7/1991 | Graham | 112/147 X |

*Primary Examiner*—Werner H. Schroeder
*Assistant Examiner*—Paul C. Lewis
*Attorney, Agent, or Firm*—Kelly O. Corley

[57] ABSTRACT

A topstitch guide for a sewing machine comprises a guide member positioned immediately prior to the presser foot and extending from the right side of the axis along which the topstitch is to be applied to a composite fabric to the left side of the axis. The composite fabric is folded along the principal seamline uniting the individual fabric components. The tip of the guide fits within the fold and engages the principal seamline so as to guide the composite fabric during the topstitching process.

2 Claims, 1 Drawing Sheet

TOPSTITCH GUIDE

The invention relates to the art of sewing of fabrics and the like, and more particularly relates to the art of sewing a topstitch.

It is sometimes desirable to apply topstitching to a composite fabric comprising two separate or individual fabric portions which have previously been sewn together along a primary seamline. One or more of the seam allowances is then folded back under a selected one of the fabric portions along the primary seamline, and the topstitching is then applied from the front side of the selected fabric portion parallel to the primary seamline, sewing together the selected fabric portion and one or more of the seam allowances. Topstitching is frequently used to emphasize a construction detail, to hold seam allowances flat, or to add interest to a plain fabric.

When topstitching in the usual manner, normal stitching guides will not, as a rule, be visible. Some assistance may be had by attempting to use the presser foot, or tape or basting applied by hand to the selected fabric portion, as a guide.

When carefully used, such methods can provide satisfactory topstitching, although they are laborious and somewhat difficult to accomplish in practice.

No generally satisfactory solution to the problem of applying topstitching accurately and rapidly to fabrics by relatively unskilled sewing machine operators is known.

According to the present invention, these and other difficulties of the prior art are avoided by provision of a topstitch guide as disclosed below.

According to a first primary aspect of the invention, there is provided an underseam topstitch guide for a sewing machine for sewing a topstitch on a composite fabric comprising two individual fabric portions which have previously been sewn together along a primary seamline separating the major portions of the previously individual fabrics from their associated seam allowances and at least one of the seam allowances is folded along the primary seamline under a selected one of the individual fabric portions to form thereby a fold. The sewing machine has an upper fabric-supporting surface comprising a fabric feed mechanism for feeding composite fabric along an axis from front to rear along the supporting surface to a sewing needle located on the axis, the sewing machine further having a presser foot for pressing the composite fabric into contact with the supporting surface prior to engagement of the needle with the composite fabric along the axis. The topstitch guide comprises a guide member extending from a first side, which may be, as illustrated, the right side, to a second side of the axis in front of the needle above the supporting surface and in the immediate vicinity of the presser foot, the guide member terminating in tip means for engaging the primary seamline within the fold along the second side of the axis; whereby the composite fabric may be fed through the sewing machine with the tip means within the fold and in contact with the primary seamline thereby guiding the composite fabric just prior to engagement therewith by the needle.

According to another aspect of the invention, the presser foot comprises a left toe extending forwardly of and alongside the left side of the needle, the presser foot further comprising a right toe extending forwardly of and alongside the right side of the needle.

According to another aspect of the invention, the left toe has a bottom surface lower than the bottom surface of the right toe.

According to another aspect of the invention, the supporting surface is relieved to accommodate the thickness of the fold in the composite fabric.

According to another aspect of the invention, the tip engages and guides the primary seamline on the left side of the axis, whereby the topstitch seamline is applied to the right of the primary seamline.

Other aspects will in part appear hereinafter and will in part be apparent from the following detailed description taken together with the accompanying drawings, wherein.

Figure 1:
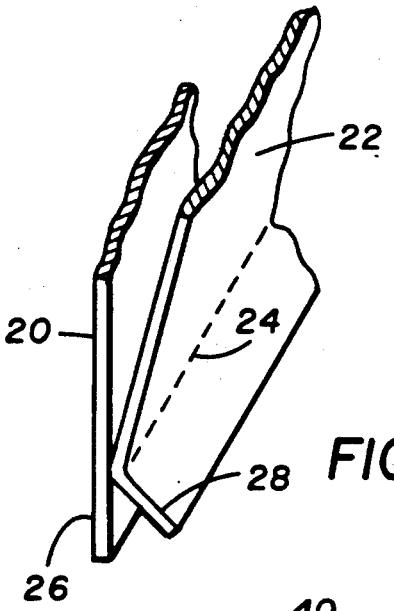
FIG. 1 is an isometric view of two fabrics sewn together in preparation for formation of the topstitch.

With reference to FIG. 1, two individual fabrics having major portions 20 and 22 have previously been sewn together along primary seamline 24 to form a composite fabric, individual fabric 20 having conventional seam allowance 26 and individual fabric 22 having conventional seam allowance 28.

Figure 2:
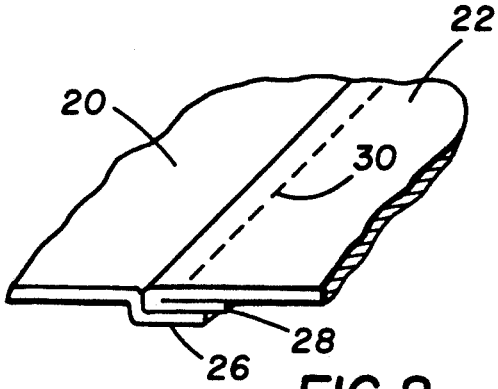
FIG. 2 is an isometric view of the desired finished product wherein the topstitch has been applied.

With reference to FIG. 2, seam allowance 28 (or, as illustrated, both seam allowance 28 and seam allowance 26) are then folded along primary seamline 24 to the right under individual fabric 22 to form thereby a fold, and are then sewn to individual fabric 22 by application of topstitch 30. FIG. 2 thus illustrates the desired finished topstitched product.

Figure 3:
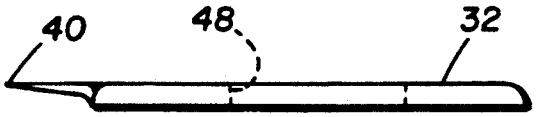
FIG. 3 is a front elevation view of the preferred embodiment of a topstitch guide according to the invention.
Figure 4:
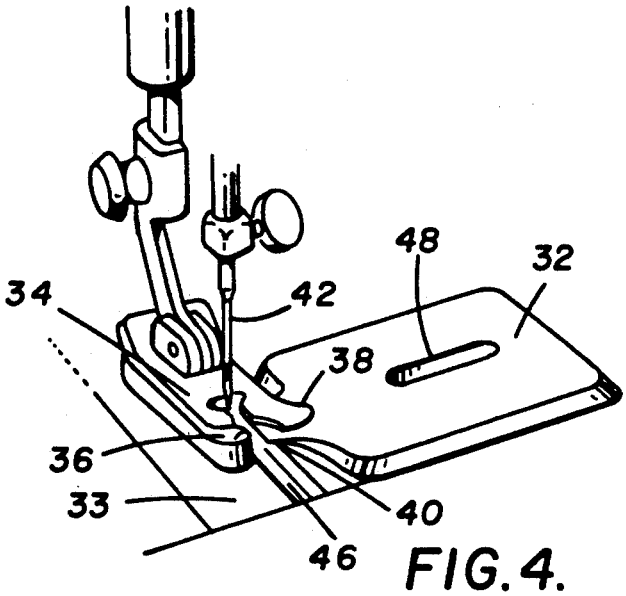
FIG. 4 is an isometric view of the topstitch guide as applied to a preferred sewing machine, without the composite fabric.
Figure 5:
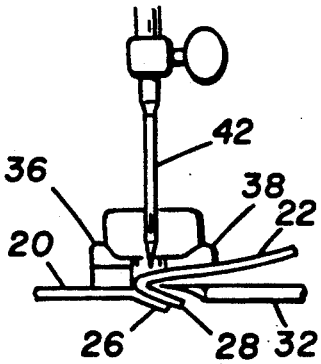
FIG. 5 is a front elevation view, partly exploded away, of the FIG. 4 apparatus, the fabric-supporting surfaces being omitted for the sake of clarity, showing the topstitch guide just prior to the final adjustment.

FIGS. 3, 4, and 5 illustrate the preferred topstitch guide 32 according to the invention, with FIGS. 4 and 5 showing the relationship of guide 32 to the relevant parts of the sewing machine. The sewing machine comprises a nonillustrated fabric feed mechanism for feeding the composite fabric along an axis from front to rear of an upper fabric supporting surface 33 to a sewing needle located along the axis. The sewing machine further has presser foot 34 for pressing composite fabric into contact with supporting surface 33 prior to engagement of needle 42 with the composite fabric to form topstitch seam 30 (FIG. 2) along the axis.

According to the invention, topstitch guide 32 extends from a first side to the opposite side of the feed axis along which topstitch 30 is to be applied, as illustrated, from the right side to the left side, extending above supporting surface 33 and across the feed axis. Guide member 32 terminates in tip means 40 for engaging primary seamline 24 within the fold along the left side of the feed axis, such that the composite fabric may be fed through the sewing machine with tip 40 within the fold formed by folding seam allowance 28 (or both seam allowances) against the underside of individual fabric 22, thereby guiding the composite fabric just prior to engagement thereby with needle 42.

FIG. 5 shows the apparatus just prior to the final adjustment, wherein guide 32 and tip means 40 would be moved to the left until tip means 40 engages and maintains primary seamline 24 a selected distance to the left of needle 42 positioned along the fabric feed axis along which topstitch seam 30 is to be formed.

With reference to FIG. 4, supporting surface 33 is preferably relieved as by the illustrated groove 46 to accommodate the thickness of the fold in the composite fabric. Topstitch guide 32 is preferably provided with slot 48 or equivalent by means of which guide 32 may be held in position once the desired final adjustment has been made, as by tightening a screw passing through slot 48 into a threaded aperture in upper surface 33.

In the preferred embodiment illustrated, foot 34 comprises left toe 36 extending forwardly of and alongside the left side of needle 42, and right toe 38 extending forwardly of and alongside the right side of needle 42. Preferably, left toe 36 has a bottom surface lower than the bottom surface of right toe 38, such that left toe 38 can, in cooperation with groove 46, accommodate the added thickness of the fold. When so provided, the fold may be abutted against the rightmost vertical surface of toe 36 as illustrated in FIG. 5, whereupon the rightmost vertical surface of toe 36 functions as an additional guiding means. In such case, the portion of individual fabric 22 alongside primary seam 24 would be confined between the rightmost vertical surface of toe 36 and tip 40.

I claim:

1. A method for sewing on a sewing machine a topstitch on a composite fabric comprising two individual fabrics, each of said individual fabrics comprising a major portion and an associated seam allowance, said individual fabrics having previously been sewn together along a primary seamline separating said major portions of said individual fabrics from said associated seam allowances and at least one of said seam allowances is folded along said primary seamline to form thereby a fold, said sewing machine having an upper supporting surface and having a fabric feed mechanism for feeding said composite fabric along an axis from front to rear along said supporting surface to a sewing needle located on said axis, said sewing machine further having a presser foot for pressing said composite fabric into contact with said supporting surface prior to engagement of said needle with said composite fabric along said axis, said sewing machine further comprising a guide member extending from a first side to the opposite side of said axis in front of said needle above said supporting surface and in the immediate vicinity of said presser foot, said guide member terminating in tip means for engaging said primary seamline within said fold along said opposite side of and above said axis, said method comprising feeding said composite fabric through said sewing machine with said tip means within said fold and in contact with said primary seamline thereby guiding said composite fabric just prior to engagement therewith by said needle.

2. The method defined in claim 1, wherein said guide member is mounted on said supporting surface.

* * * * *